US006161224A

United States Patent [19]

Tuetken

[11] Patent Number: 6,161,224

[45] Date of Patent: Dec. 19, 2000

[54] REMOVABLE APPLIQUE APPARATUS

[76] Inventor: F. Elizabeth Tuetken, 1834 Greensprings La., Germantown, Tenn. 38138

[21] Appl. No.: 09/384,874

[22] Filed: Aug. 27, 1999

Related U.S. Application Data

[60] Provisional application No. 60/111,413, Dec. 8, 1998.

[51] Int. Cl.[7] ..... A41D 27/08

[52] U.S. Cl. ..... 2/244

[58] Field of Search ..... 2/244, 245, 246, 2/251, 279, 268, 160; 24/13, 351, 3.1, 5, 15, 3.12, 66.4, 66.5, 66.11; 132/273; 63/33, 20

[56] References Cited

U.S. PATENT DOCUMENTS

| | | | |
|---|---|---|---|
| 107,614 | 9/1870 | Helwig | 2/246 |
| 111,456 | 1/1871 | Horstmann | 2/246 |
| 887,149 | 5/1908 | Tarnow | 2/245 |
| 1,719,632 | 7/1929 | Taylor . | |
| 1,776,673 | 9/1930 | Tucker . | |
| 2,300,125 | 10/1942 | Lapick | 2/98 |
| 2,451,364 | 10/1948 | Spector | 2/139 |
| 2,520,539 | 8/1950 | Goldson | 2/98 |
| 2,997,718 | 8/1961 | Jacobs | 2/139 |
| 3,428,963 | 2/1969 | Centeck | 2/133 |
| 3,596,291 | 8/1971 | Thill | 2/245 |
| 3,708,804 | 1/1973 | Santos | 2/244 |
| 3,860,967 | 1/1975 | Tedesco | 2/129 |
| 4,975,987 | 12/1990 | Teachout et al. | 2/246 |
| 5,136,726 | 8/1992 | Kellin et al. | 2/244 |
| 5,203,033 | 4/1993 | Sheppard, Sr. et al. | 2/69 |
| 5,308,671 | 5/1994 | Wells | 428/99 |
| 5,398,345 | 3/1995 | Kenneth et al. | 2/247 |
| 5,697,387 | 12/1997 | Hanisco | 132/275 |
| 5,740,557 | 4/1998 | Reid et al. | 2/209.13 |
| 5,785,065 | 7/1998 | Johnson | 132/275 |
| 5,803,266 | 9/1998 | Blackwelder | 206/575 |
| 5,836,017 | 11/1998 | Hironaga et al. | 2/69 |
| 5,975,092 | 11/1999 | Tsai | 132/275 |

*Primary Examiner*—John J. Calvert
*Assistant Examiner*—Alissa L. Hoey
*Attorney, Agent, or Firm*—Garvey, Smith, Nehrbass & Doody, L.L.C.

[57] ABSTRACT

A decorative applique that is removably affixed to a garment including collars (removable or permanently attached), pockets and accessories (such as hats, pocketbooks and shoes) which can be removably affixed to such as a user's garment, for example a blouse or a dress or the accessory. The removable applique is adapted for mounting at multiple locations for any one of a number of selected appliques with a spring action clip similar to those in children's barrettes that can be selectively affixed to the outer surface of the garment, at selected locations, the clips having a pivotal, elongated attaching bar that enables the clip to be fastened to either the garment/collar or to the use's hair and fashion accessories.

13 Claims, 5 Drawing Sheets

REMOVABLE APPLIQUE APPARATUS

CROSS-REFERENCE TO RELATED APPLICATIONS

This Application relates to Provisional Patent Application Ser. No. 60/111,413 entitled REMOVABLE APPLIQUE APPARATUS, filed Dec. 8, 1998.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved removable applique apparatus for children's garments including collars (removable or permanently attached), pockets and accessories (such as hats, pocketbooks and shoes) which can be removably affixed to such as a user's garment, for example a blouse or a dress or a "fashion" accessory. More particularly, the present invention relates to an improved apparatus that provides multiple mounting locations for any one of a number of selected appliques with spring action clips similar to those utilized in children's barrettes that can be selectively affixed to the outer surface of the garment or accessory, at selected locations, the clips having a pivotal, elongated attaching bar that enables the clip to be fastened to either the garment/collar or to the user's hair and alternatively, fashion accessories.

2. General Background of the Invention

One method of changing the look of an outfit is to change artistic appliques that are applied to the outfit, dress, blouse, etc. Similarly, the garment might have a collar that is removable so as to also give a different look to a garment as by changing the collar style. It is an object of the present invention to facilitate a change in the look of a garment with a unique combination of applique and collar and the attachment used so that appliques may be applied to the body of the garment, the collar, accessories or even to a user's hair as desired and remain securely in place.

As those close to children are well aware, young children have a seemingly insatiable curiosity prompting them to explore all aspects of their milieu, from toys to furniture to garments. Anything which may be opened, emptied or rearranged, will be. In respect to clothing, the addition of removable appliques to garments provides the child with an additional avenue for occupation and imagination. It is imperative however, that in the instance to removable or relocateable adornments, that the attachment means be not easily separated from the garment, and if so, is of a size to not present an opportunity for ingesting. It is well known to attach collars and adornments such as appliques to clothing with snaps, hook and loop fastening and buttons. I have found that these mechanisms for attaching the discussed articles to garments are less suitable for a number of reasons. Buttons and snaps are relatively easily separated from the garment or the attachment and when so separated are easily ingested by an undiscerning young child. Likewise, the snap or button attached adornment may be too easily removed from the garment such that the applique or adornment will frequently become misplaced or lost. Hook and loop fastening is subject to a similar criticism.

The apparatus of my invention, including attachment by means of a clip mechanism having a pivotal securing bar capable of being retained at one end in a detent through such as a spring-type compression force provides an improved mechanism for attaching an adornment such as an applique or collar to a child's garment. Further by using such a reliable, secure mechanism, the applique may also be selectively attached to the hair or other clothing including play shoes (e.g., sneakers), handbags and hats.

BRIEF SUMMARY OF THE INVENTION

The present invention provides an improved removable applique apparatus in the form of an applique member which is removably affixed to a garment such as a dress, blouse or accessories such as shoes, hats and hand bags. Removable apparatus similar in holding action to barrette-type clips are provided for joining an applique the garment.

An outwardly positioned portion of the garment, such as the collar and pocket are preferably provided with a plurality of attachments openings for receiving clips at spaced apart positions over the outwardly positioned portion of the garment. The clips may thus be selectively affixed to one or more of the attachment openings of the garment at selective locations. This enables a user to attach a clip containing an applique to the collar member at one or more selected positions. A user can also remove those clips during the course of a day and apply the applique to the user's hair or an accessory for example, enabling a change to the look of an outfit. Likewise the applique may include indicia of a profession (nurse, policeman, pilot, etc.) or position such that the applique may be utilized for play and character representation whether applied to the garment or an accessory such as a hat, bag, shoe or the like.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 2:
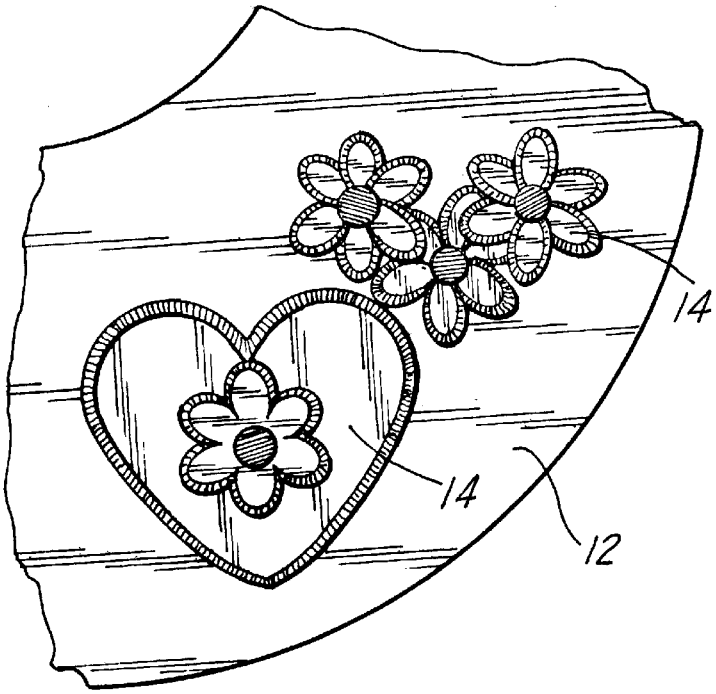
FIG. 2 is a pictoral view of the preferred embodiment of the apparatus of the present invention illustrated in FIG. 1.
Figure 1:
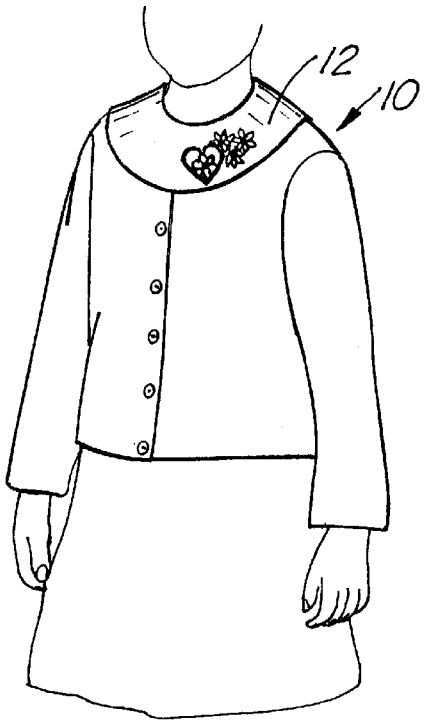
FIG. 1 is a pictoral view of a preferred embodiment of the apparatus of the present invention illustrating the removable applique on a garment.
Figure 3:
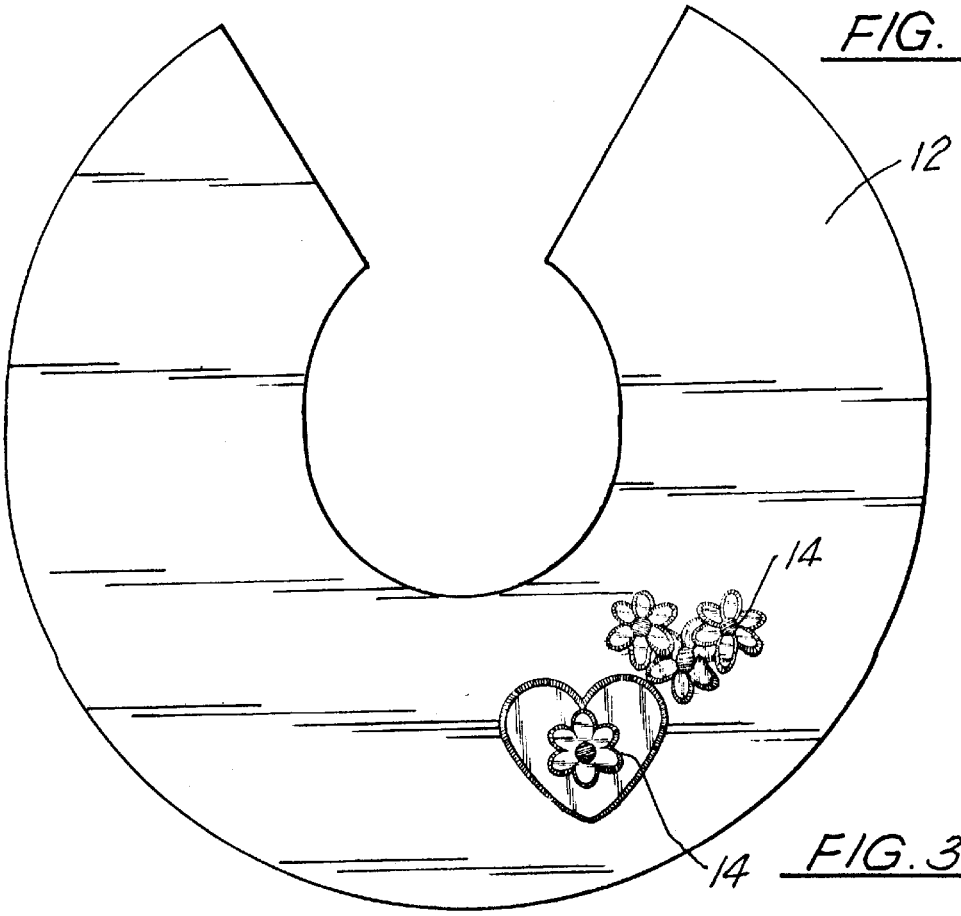
FIG. 3 is a plan view of the removable applicable of a preferred embodiment of the apparatus of the present invention on a removable collar.
Figure 4:
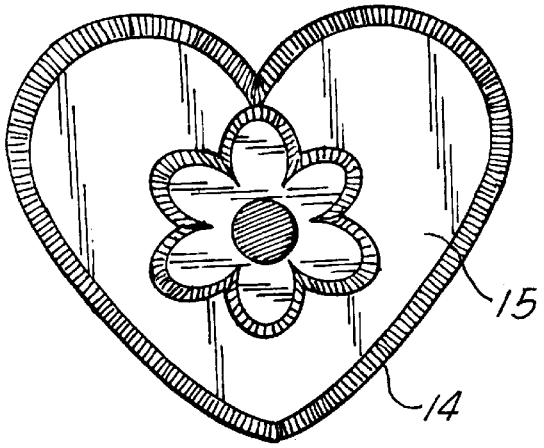
FIG. 4 is a plan view of a single removable applique of the preferred embodiment of the apparatus of the present invention.

FIG. 1 illustrates a garment 10 for a child having a collar 12 attached thereto. As will be later discussed, collar 12 may be permanently attached to garment 10, or detachable by being affixed with one of a variety of known attachment means. FIG. 2 illustrates a detachable collar 12 having disposed thereon appliques 14, which in the illustrated embodiment are two independent, removably attachable applique according to the present invention and described in greater detail below. FIG. 3 illustrates appliques 14 disposed on collar 12 in greater detail. Collar 12 is illustrated as a detachable collar which may be removably attached to such as the garment 10 of FIG. 1.

Figure 5:
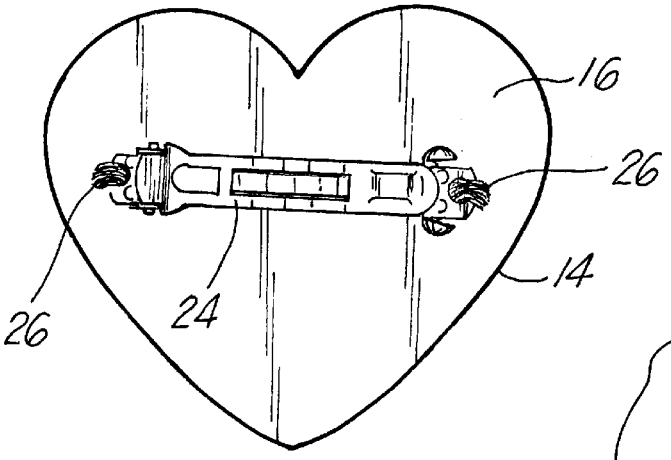
FIG. 5 is a rear view of the removable applique of the present invention on a garment showing the mounting of the fastening clip to the applique.
Figure 6:
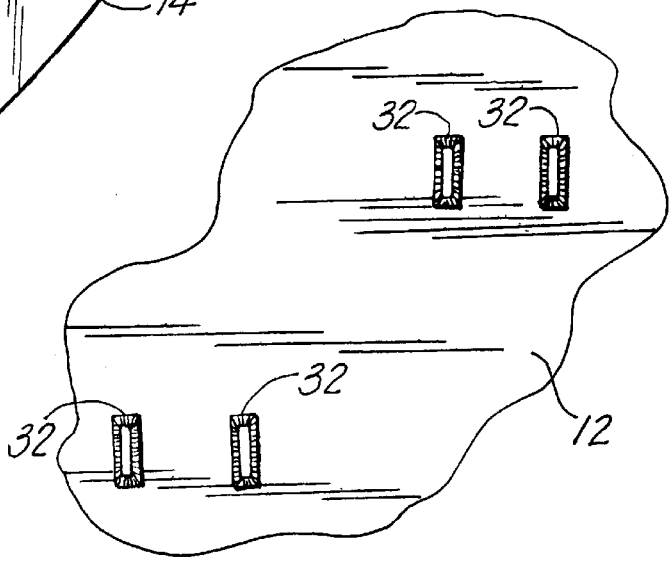
FIG. 6 is a partial plan view of the apparatus of the present invention showing the mounting site for the applique of the present invention.
Figure 7:
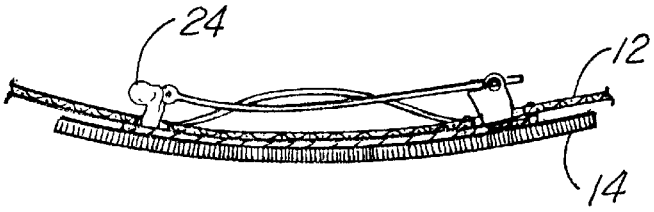
FIG. 7 is a side elevational view of a preferred embodiment of the apparatus of the present invention illustrating the mounting of a clip on an applique according to the present invention.
Figure 8:
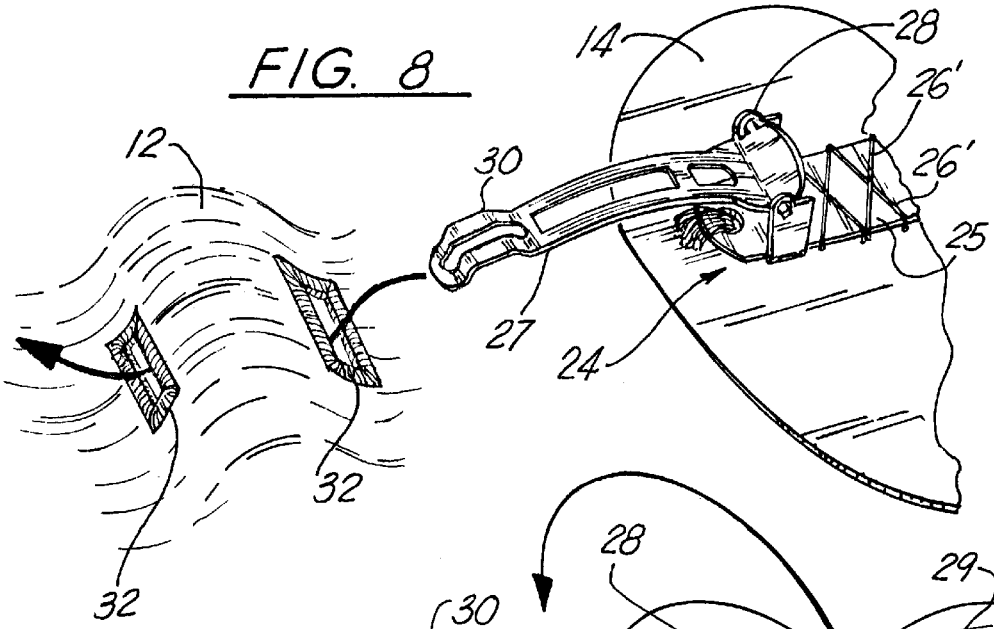
FIG. 8 is a pictoral view of the apparatus of the present invention being installed in mounting site clip hole attachments.
Figure 9:
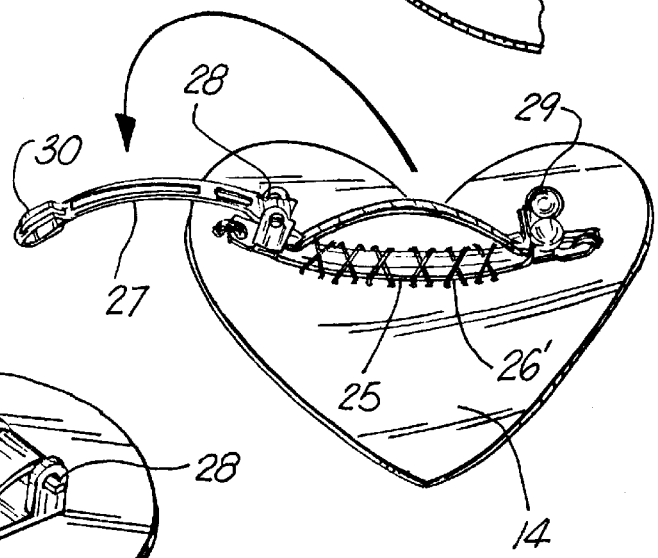
FIG. 9 is a pictoral view showing operation of the mounting clip of the apparatus of the present invention.

Referring now generally to FIGS. 4 through 9, a detailed construction of the applique 14 including a preferred embodiment of the apparatus of the present invention incorporating fastening clip 24. Applique 14 has a front surface portion 15 which preferably displays a desired artistic design such as the plurality of flower petals, or heart shape as shown in FIGS. 1 through 4. The rear surface 16 of applique 16 provides an attachment location for clip 24 that is attached to rear surface 16 of applique 14 using attachment means described below. In FIGS. 5 and 7 through 9, applique 14 is illustrated having fastening clip 24 attached to applique 14 which in the illustrated embodiment is by sewing as at stitches 26. In FIG. 5, clip 24 is attached to applique 14 with stitches 26 which are shown to attach clip base 25 at its respective ends. In FIGS. 8 and 9, stitches 26' are shown to crisscross over base 25 of clip 24. The illustrated fastening clip 24 is of a barrette-type having a closing bar 27 which is pivotally mounted as at pivot 28. Closing bar 27, in the closed position as illustrated in FIGS. 5 and 7 is retained by detents 29 mounted on base 25 opposite pivot 28.

A number of selected appliques 14 may be attached to collar 12, or such as a pocket or other preferred location on a garment, such as at one or multiple spaced apart locations as selected by the user. This enables a user to wear one applique 14 at a selected location, a pair of appliques 14 (as illustrated in FIGS. 1 through 3) at selected spaced apart locations, or to vary the number and placement of appliques 14 at different locations on the outer surface of the collar 12, or selected location, The attachment of the applique 14 to a selected location as at one of the paired holes 32 in collar 12, as illustrated in FIG. 6. The installation of the applique on to the collar or other selected mounting is accomplished by inserting the closing bar 27 including pivot 28 into respective ones of paired holes, as illustrated in FIG. 8, whereupon applique 14 is rotated such that detent 29 engages the clip end 30 of closing bar 27. Applique and clip 24 may then be adjusted such that detent and pivot 28 extend through collar 14 (or other mounting location) at paired holes 32 such that closing bar 27 is retained on the opposite side of collar as applique, in parallel relation. Alternatively, detent 29 and closing bar (partially open to approximately a 90°) may be respectively inserted into pared holes 32 until base 25 is adjacent collar 14 such that when so inserted and closing bar 27 is rotated to the locked position in detent 29 shown in FIGS. 4.

Figure 10:
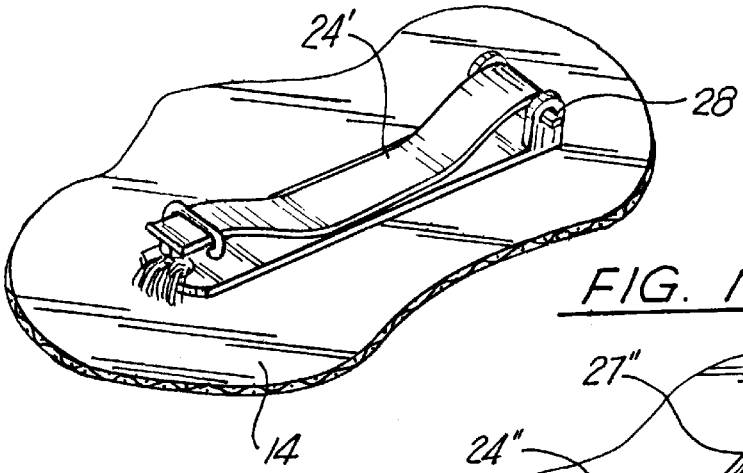
FIG. 10 is a pictoral view of an alternative embodiment of mounting clip of the present invention.
Figure 11:
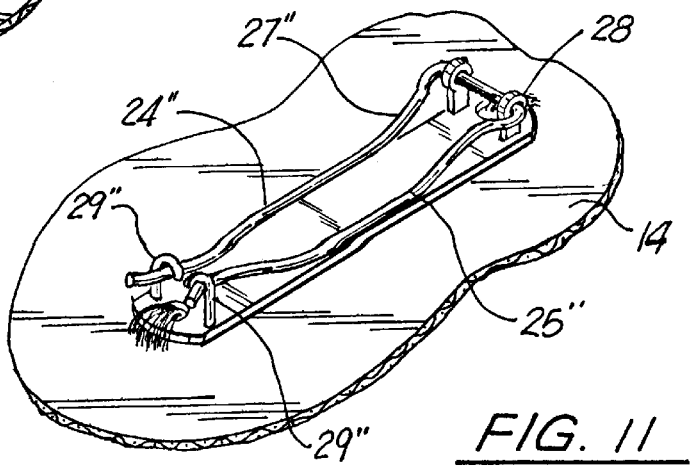
FIG. 11 is a pictoral view of another alternative embodiment of mounting clip of the present invention.
Figure 12:
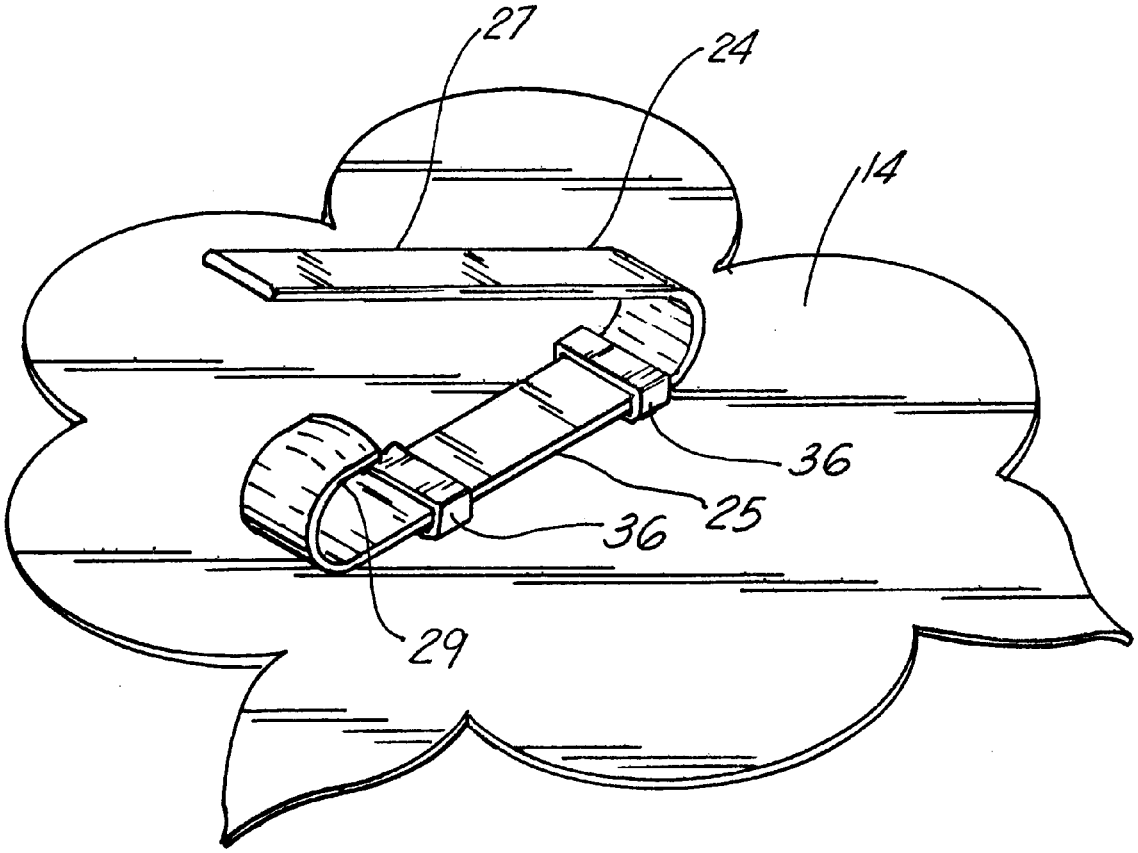
FIG. 12 is a pictoral view of an additional alternative embodiment of mounting clip of the present invention.
Figure 13:
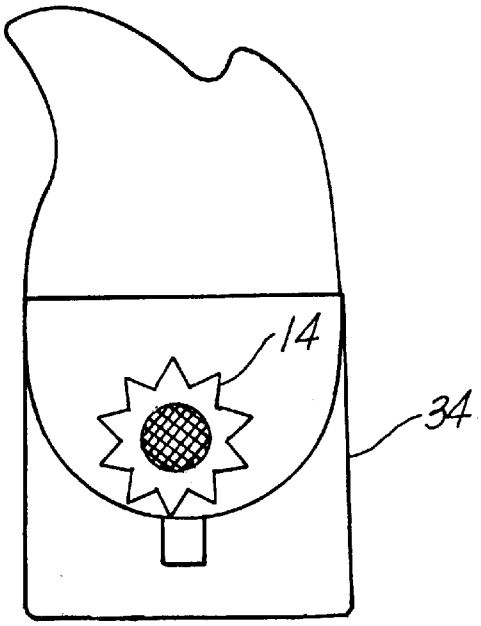
FIG. 13 is a pictorial view of a preferred embodiment of the apparatus of the present invention illustrating the removable applique on a hand-held container.
Figure 14:
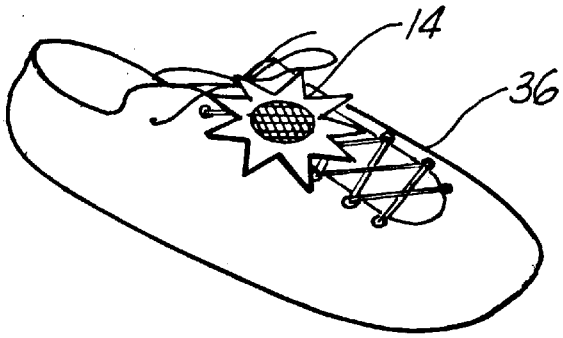
FIG. 14 is a pictorial view of a preferred embodiment of the apparatus of the present invention illustrating the removable applique on a shoe.
Figure 15:
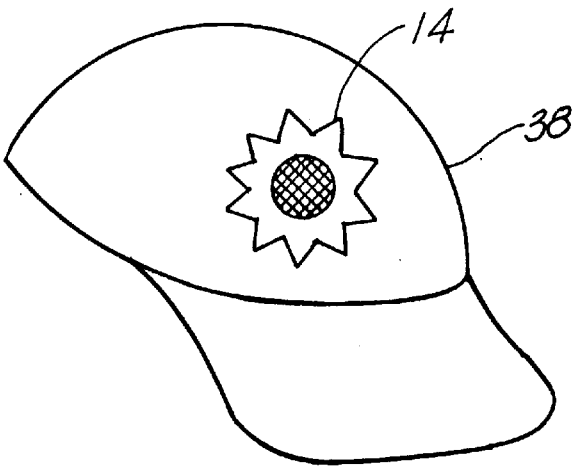
FIG. 15 is a pictorial view of a preferred embodiment of the apparatus of the present invention illustrating the removable applique on a hat.
Figure 16:
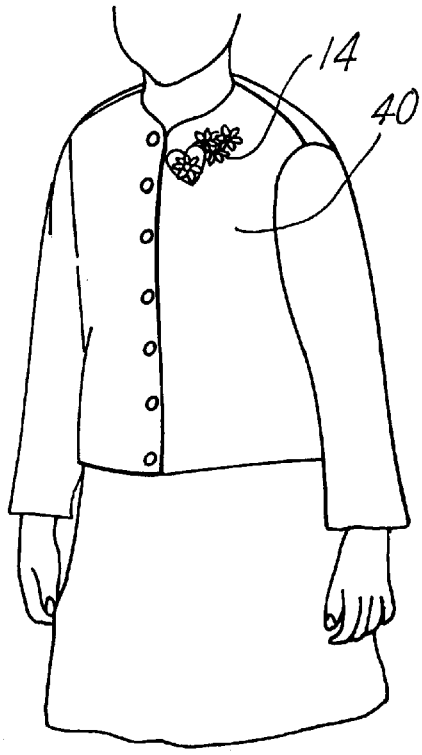
FIG. 16 is a pictorial view of a preferred embodiment of the apparatus of the present invention illustrating the removable applique on a blouse.

FIGS. 10, 11 and 12 illustrate alternative types fastening clips 24', 24" and 24°. In FIG. 13, clip 24° is of a style wherein detent 29°, base 25°, pivot 28° and closing bar 27° are of a unitary piece of metal or plastic, wherein the pivoting action is enabled by the resilience of the material to which clip is formed, being biased toward an open position as illustrated in FIG. 13. Clip 24° may then be closed by maneuvering closing bar 27° at its free end past detent 29°, to be retained thereunder. In the illustrated embodiment of FIG. 12, the cross section of clip 24° (closing bar 27° and detent 29°) may have a concave or convex aspect such that the free end of closing bar 2°' is more securely retained in detent 29°. Also illustrated in FIG. 12 is an alternative means for securing fastening clip 24° on applique 14. As illustrated, rather than base 25° being sewn to the applique, it may be attached by such as staples 36, surrounding base 25° and being anchored in applique 14.

The alternative clip 24" illustrated in FIG. 11 utilizes a closing bar 25" formed of a U-shaped resilient wire, with detent 29" formed of adjacent J hooks, disposed on base 25" in adjacent relationship so as to receive the free ends of locking bar 27" therein, as illustrated.

The following table lists the parts numbers and parts descriptions as used herein and in the drawings attached hereto.

"FIGS. 13 through 16 illustrate the attachment of applique 14 to alternative articles of apparel including a hand-held container 34 (e.g., a purse), shoe 36, hat 38 and blouse 40."

PARTS LIST

| Part Number | Description |
|---|---|
| 10 | garment |
| 12 | collar |
| 14 | applique |
| 15 | front surface |
| 16 | rear surface |
| 24 | clip |
| 24' | clip |
| 24" | clip |
| 24° | clip |
| 25 | base |
| 25' | base |
| 25" | base |
| 25° | base |
| 26 | stitches |
| 27 | closing bar |
| 27' | closing bar |
| 27" | closing bar |
| 27° | closing bar |
| 28 | pivot |
| 28' | pivot |
| 28" | pivot |

-continued

PARTS LIST

| Part Number | Description |
|---|---|
| 28° | pivot |
| 29 | detents |
| 29' | detents |
| 29" | detents |
| 29° | detent |
| 30 | clip end |
| 32 | pared holes |
| 34 | hand-held container |
| 36 | shoe |
| 38 | hat |
| 40 | blouse |

The foregoing embodiments are presented by way of example only; the scope of the present invention is to be limited only by the following claims.

What is claimed is:

1. An article of apparel and a removable applique member for attachment to the article, comprising:

a) the article having a pair of attachment openings for receiving a fastening clip at spaced apart positions for fastening said applique member to said article;

b) said removable applique member is removably affixed to the article by a fastening clip, said applique member having an inwardly positioned surface and said fastening clip being disposed thereon, for selective attachment of the applique member to the article and an outwardly positioned surface for mounting a decorative appearance; and c) said fastening clip having a base portion and a hinged closing bar, said closing bar being secured to said base portion at a first end thereof and said base portion having a clasp at a second end for receiving the free end of said closing bar;

whereby said member is attached to said article by said closing bar being inserted through said pair of attachment openings and received in said clasp.

2. The combination of claim 1 wherein said closing bar is hingedly attached to said base portion with a free turning pivot.

3. The combination applique of claim 2 wherein said closing bar is a U-shaped wire and the base of said U is mounted in said free turning pivot.

4. The combination of claim 1 wherein said base portion of said fastening clip includes a raised portion at said second end and includes a detent and said detent is aligned to receive the free end of said closing bar.

5. The removable applique of claim 1 wherein the article is a dress.

6. The removable applique of claim 1 wherein the article is a blouse.

7. The removable applique of claim 1 wherein the article is a fashion accessory.

8. The fashion accessory of claim 1 wherein the accessory is a shoe.

9. The fashion accessory of claim 1 wherein the accessory is a hand held container.

10. The fashion accessory of claim 1 wherein the accessory is a hat.

11. The fashion accessory of claim 1 wherein the accessory is a detachable collar.

12. The combination of claim 1 wherein said pair of said attachment openings comprise a pair of spaced apart slots in the article through which said closing bar is inserted for attachment to the article.

13. The combination of claim 12 wherein said a pair of spaced apart slots in the article through which said closing bar is inserted for attachment to the article are rectangular.

* * * * *